US005785621A

United States Patent [19]

Birzele

[11] Patent Number: 5,785,621

[45] Date of Patent: Jul. 28, 1998

[54] WOVEN BELT FOR A CORRUGATED CARDBOARD MACHINE

[75] Inventor: Armin Birzele, Ulm, Germany

[73] Assignee: Mühlen Sohn GmbH & Co., Blaustein, Germany

[21] Appl. No.: 809,166

[22] PCT Filed: Nov. 2, 1994

[86] PCT No.: PCT/EP94/03603

§ 371 Date: Mar. 3, 1997

§ 102(e) Date: Mar. 3, 1997

[87] PCT Pub. No.: WO96/07788

PCT Pub. Date: Mar. 14, 1996

[30] Foreign Application Priority Data

Sep. 3, 1994 [DE] Germany ..... 9414344 U

[51] Int. Cl.[6] ..... F16G 1/00

[52] U.S. Cl. ..... 474/267; 474/268; 474/270

[58] Field of Search ..... 474/266, 267, 474/268, 270

[56] References Cited

U.S. PATENT DOCUMENTS 2,612,190 9/1952 Hall ..... 139/426

FOREIGN PATENT DOCUMENTS 2922025 12/1979 Germany .
4127164 2/1993 Germany .

*Primary Examiner*—William Stryjewski
*Attorney, Agent, or Firm*—Robert W. Becker & Associates

[57] ABSTRACT

A woven belt for a corrugated cardboard machine has a central woven layer for absorbing tensile stress which consists of first warp and weft threads. The first warp threads cross at least two first weft threads on one side of the central layer before crossing over to the other side. A woven top layer is connected to the upper side and a woven bottom layer is connected to the bottom side of the central layer. The top layer provides a support surface for the cardboard and has second warp and weft threads. The second warp threads cross at least two second weft threads on one side of the top layer before crossing over to the other side. The bottom layer has third warp and weft threads. The third warp threads cross one third weft thread on an inner side of the bottom layer before crossing over to the outer side. The third warp threads cross at least three third weft threads on the outer side of the bottom layer before crossing over to the inner side. First binding threads for weaving together the top layer and the central layer and second binding threads for weaving together the bottom layer and the central layer are provided. The weft threads are tied off within the three layers. The woven belt has longitudinal edge portions and a longitudinal center portion therebetween. The second warp threads include at least one outer warp thread positioned within the edge portions and inner warp threads positioned within the center portion. The outer warp thread extends longitudinally and consists of a material of a greater wear and/or a greater temperature resistance than the inner warp threads.

17 Claims, 2 Drawing Sheets

WOVEN BELT FOR A CORRUGATED CARDBOARD MACHINE

BACKGROUND OF THE INVENTION

The invention relates to a woven belt for a corrugated cardboard machine comprising a central woven layer for absorbing tensile stress, wherein the central woven layer is comprised of first warp threads and first weft threads and wherein a weave pattern of the central woven layer is such that the first warp threads cross at least two of the first weft threads on one side of the central woven layer before crossing over to the other side of the central woven layer. A woven top layer is connected to the upper side of the central woven layer and a woven bottom layer is connected to the bottom side of the central woven layer. The woven top layer provides a support surface for the cardboard. The woven top layer is comprised of second warp threads and second weft threads, wherein a weave pattern of the woven top layer is such that the second warp threads cross at least two of the second weft threads on one side of the woven top layer before crossing over to the other side of the woven top layer. The woven bottom layer is comprised of third warp threads and third weft threads, wherein a weave pattern of the woven bottom layer is such that the third warp threads cross one of the third weft threads on the inner side of the woven bottom layer facing the central woven layer before crossing over to the outer side of the woven bottom layer and wherein the third warp threads cross at least three of the third weft threads on the outer side of the woven bottom layer before crossing over to the inner side of the woven bottom layer. The second warp threads are arranged in first thread groups and are staggered relative to one another within each one of the first thread groups. The third warp threads are arranged in second thread groups and are staggered relative to one another within each of the second thread groups. First binding threads for weaving together the woven top layer and the central woven layer are provided. Second binding threads for weaving together the woven bottom layer and the central woven layer are provided. The first, second, and third weft threads are tied off within the woven top layer, the central woven layer, and the woven bottom layer, respectively.

Such a belt is known from DE 41 27 164 A1. This belt exhibits quiet running properties and thus has a considerably reduced noise level at the location of use. It has a long service life whereby with increasing time of use the woven layer facing the paper side have shown surface changes which may negatively affect the quality of the cardboard surface. Thus, the currently used belt is frequently exchanged already when only slight changes of the surface quality appear even though, based on its construction, it is suitable for a longer time of use.

It is an object of the invention to embody a belt for a corrugated cardboard machine such that even for an extended period of use a uniform surface quality of the cardboard is ensured.

SUMMARY OF THE INVENTION

This object is solved by the woven belt in a longitudinal direction thereof having longitudinal edge portions and a longitudinal center portion between the edge portions and the second warp threads including at least one outer warp thread positioned within the edge portions and inner warp threads positioned within the center portion. The at least one outer warp thread extends in a longitudinal direction of the woven belt and consists of a material having at least one of a greater wear resistance and a greater temperature resistance than the inner warp threads.

The at least one outer warp thread is positioned directly adjacent to a longitudinal edge of the edge portions.

The woven belt may comprise a plurality of the outer warp threads arranged adjacent to a longitudinal edge of the edge portions.

The first binding threads, extending in the longitudinal direction of the woven belt, consist of the same material as the at least one outer warp thread.

Advantageously, all of the warp threads within the edge portions and all of the binding threads within the edge portion consist of the same material as the at least one outer warp thread.

Expediently, the edge portions have a width transverse to the longitudinal direction of the woven belt of 200 mm.

The material of the at least one outer warp thread is preferably an aromatic polyamide. The aromatic polyamide is preferably Kevlar.

The material of the at least one outer warp thread may be a mixture of an aromatic polyamide and metal fibers. The metal fibers are preferably stainless steel fibers. The mixture expediently consists of 96.5% of the aromatic polyamide and 3.5% of the metal fibers based on the weight of the mixture.

Preferably, the warp threads, the weft threads, and the binding threads consist of 65% polyester and 35% viscose.

All of the warp threads within the edge portions and all of the binding threads within the edge portion may consist of the same material as the at least one outer warp thread, and the material is preferably an aromatic polyamide. The aromatic polyamide is expediently Kevlar.

The material is a mixture of an aromatic polyamide and metal fibers and the metal fibers are preferably stainless steel fibers. The mixture may consist of 96.5% of the aromatic polyamide and 3.5% of the metal fibers based on the weight of the mixture.

It has been shown surprisingly that a belt with accordingly reinforced longitudinal edges even for an extended period of use ensures a continuous high quality of the cardboard. This surface quality is reduced significantly only when the cardboard belt itself is worn and must be exchanged for a new belt. The inventive embodiment ensures thus an extended service life of the belt with unchanged surface quality of the paper side of the belt.

Preferably, the warp thread positioned directly adjacent to the longitudinal edge is made of a more wear-resistant and/or more temperature resistant material. Expediently, a plurality of adjacently positioned outer warp threads are arranged adjacent to the longitudinal axis of the belt which outer warp threads consist of a more wear-resistant or more temperature-resistant material than the other warp threads of the woven top layer positioned in the portion of the belt between the edge portions.

Expediently, the outer warp thread arranged within the edge portion consists of an aromatic polyamide (Aramid). For higher loads an outer warp thread of Kevlar can be used. For reaching an increased wear resistance it is possible to mix metal fibers into the material of the outer warp thread. A composition of the mixture, relative to its weight, of 96.5% polyamide and 3.5% stainless steel fibers has been proven to be advantageous.

With the exception of the outer warp threads of the woven top layer, the remaining belt of the woven top layer and the other woven layers is made of plastic fibers preferably of the same material, for example, a mixture of 65% polyester and approximately 35% viscose (viscose staple fibers).

BRIEF DESCRIPTION OF THE DRAWINGS

An exemplary embodiment of the invention is represented in the drawing and will be explained in more detail in the following. It is shown in.

DESCRIPTION OF THE PREFERRED EMBODIMENTS

Figure 1:
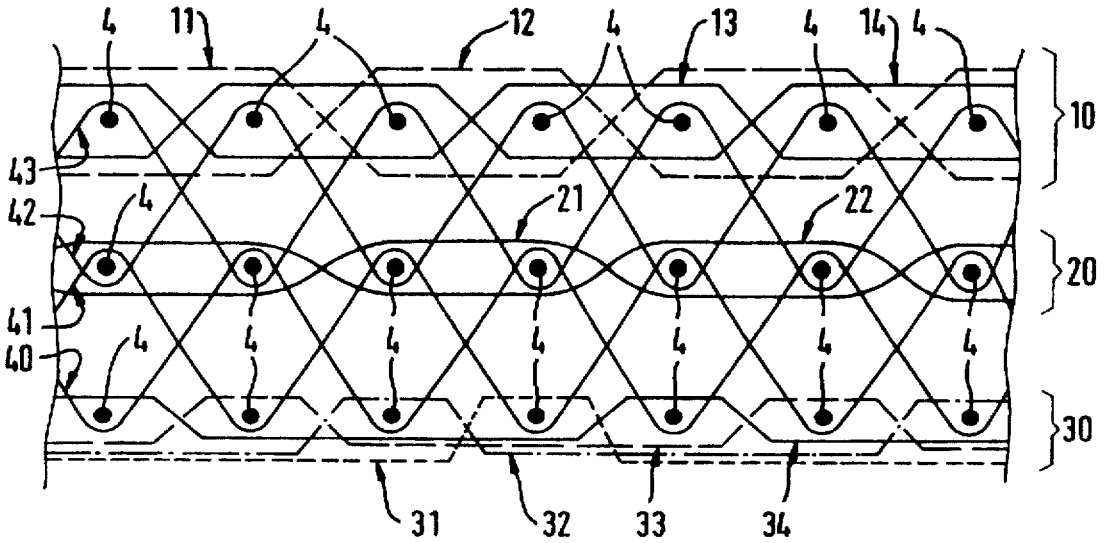
FIG. 1 a woven belt in longitudinal section.

The belt preferably produced of plastic fibers is comprised of, as is shown in FIG. 1, a woven top layer 10, a central woven layer 20, and a woven bottom layer 30. The side of the woven top layer 10 facing away from the central woven layer 20 forms the paper side of the woven belt 1 facing the cardboard.

Figure 2:
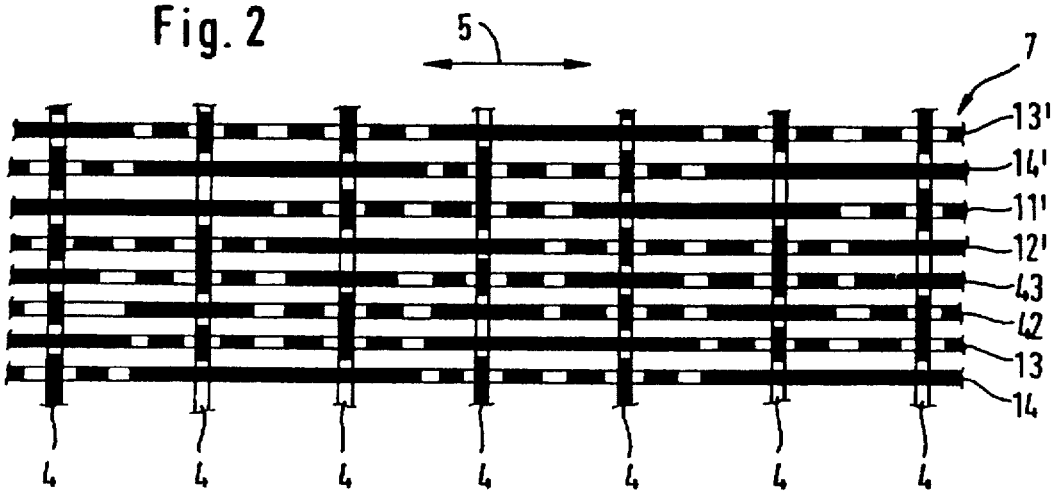
FIG. 2 a partial top view of the woven top layer facing the paper side.
Figure 3:
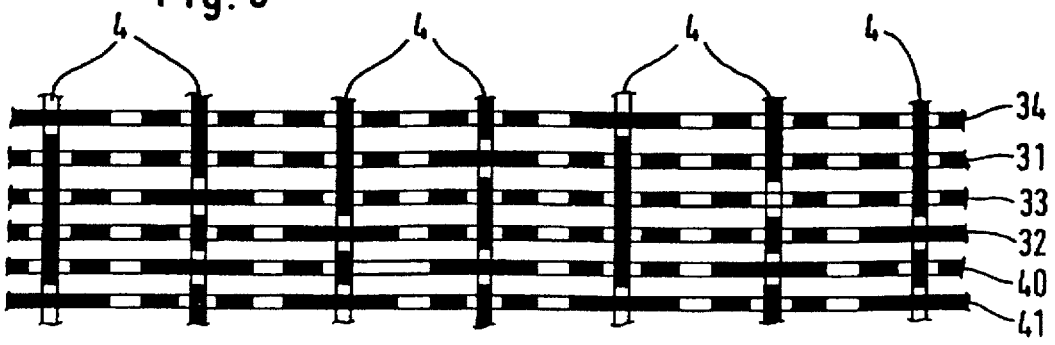
FIG. 3 a top view of the outer side of the woven bottom layer of the belt.

The weft threads 4 extend within the woven layers 10, 20, 30 transverse to the longitudinal direction 5 of the belt 1 (FIG. 2).

In the woven top layer 10 four warp threads 11, 12, 13, 14 (FIGS. 1 and 2), which are staggered relative to one another, are provided which cross at the inner side facing the central woven layer 20 as well as the outer side which is the paper side, at least two weft threads 4.

The central woven layer 20 comprises two warp threads 21, 22 staggered relative to one another which extend respectively across two weft threads 4.

The woven bottom layer 3 is comprised of four warp threads 31, 32, 33, 34 which are staggered relative to one another and which, at the inner side facing the central woven layer 20, cross only one weft thread 4 and at the outer side cross at least three weft threads 4.

The three woven layers 10, 20, 30 are interconnected by weaving via binding threads 40, 41, 42, 43. The binding threads are divided into two respective thread groups whereby the binding threads 42, 43 from one thread group and extend staggered relative to one another. They connect the woven top layer 10 to the central woven layer 20. The binding threads 42 and 43 are guided alternatingly about a weft thread 4 in the top woven layer 10 and a weft thread 4 in the central woven layer 20. In a corresponding manner, the binding threads 40 and 41 form a thread group which connects the woven bottom layer 30 to the central woven layer 20.

Figure 4:
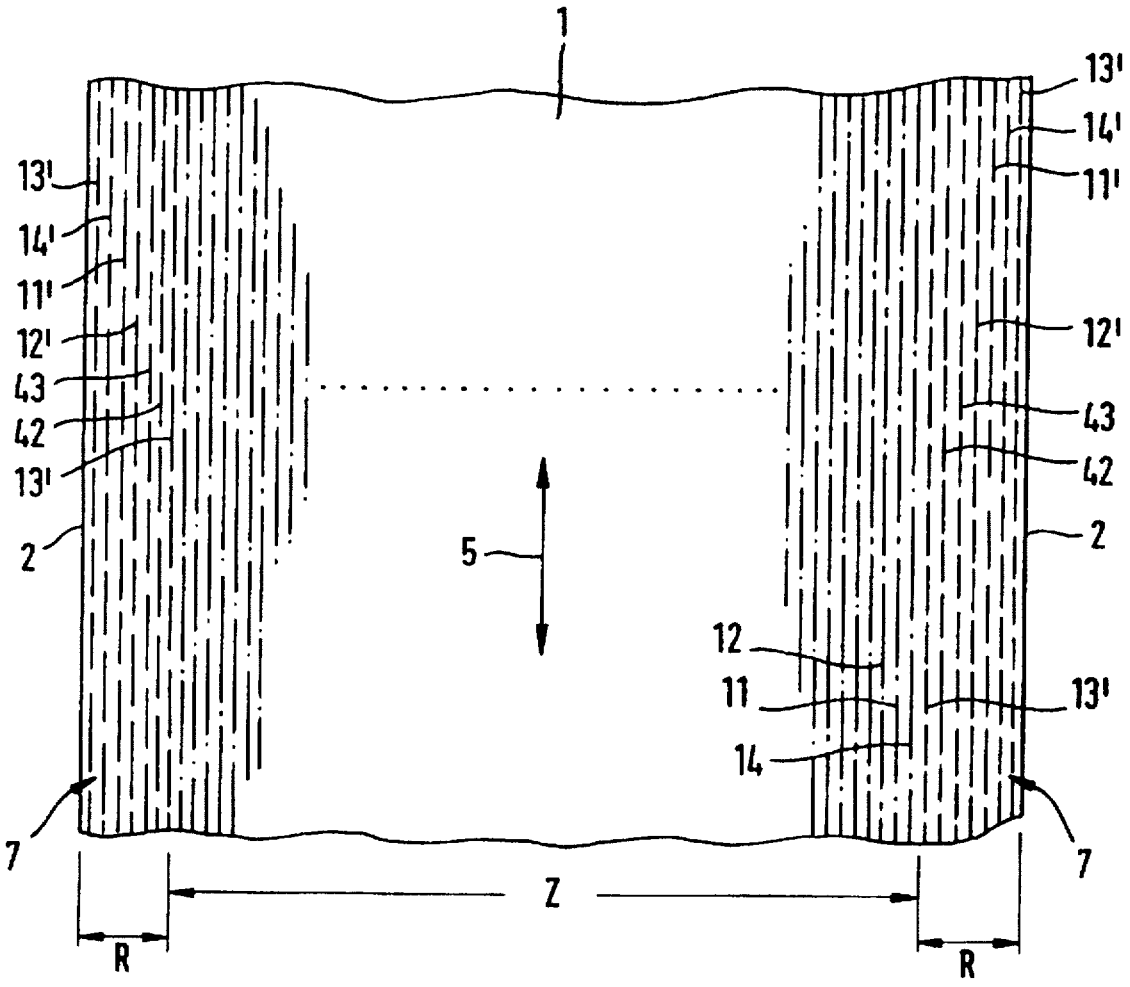
FIG. 4 a schematic top view of a woven belt according to FIG. 1.

As can be seen in FIG. 4 in connection with FIG. 2, at the edge portion 7 of the belt 1 in its woven top layer 10 at least one outer warp thread 11', 12', 13', 14' is arranged which extends in the longitudinal direction 5 of the belt 1 and which consists of a more wear-resistant and/or more temperature resistant material than the inner warp threads 11, 12, 13, 14 of the woven top layer 1 in the central portion Z extending between the edge portions 7 of the belt 1. An outer warp thread 13' of more wear-resistant and/or temperature-resistant material is positioned directly adjacent to the longitudinal edge 2 (FIG. 4) of the belt 1. Preferably, a plurality of adjacently arranged outer warp threads 11', 12', 13', 14', consisting of a more wear-resistant and/or temperature-resistant material, are provided adjacent to the longitudinal edge 2. The warp threads 11', 12', 13', 14' of more wear resistant and/or more temperature resistant material may form a thread group whereby the binding threads 42 and 43 are positioned between this and a neighboring thread group of warp threads 11', 12', 13', 14' consisting of more wear-resistant and/or more temperature-resistant material. Preferably, the binding threads 42 and 43 extending in the edge portion 7 in the longitudinal direction 5 of the belt 1 are also comprised of more wear-resistant and/or more temperature-resistant material.

In order to ensure a substantially uniform surface quality over its entire width for an extended service life of the belt, all of the longitudinally extending threads 11', 12', 13', 14', 42, 43 consist of a more temperature-resistant, respectively, more wear-resistant material. The edge portion 7 has preferably a width R of approximately 200 mm.

As a more wear-resistant, respectively, temperature resistant material, aromatic polyamide has proven successful which is also called Aramid. From the group of polyamides Kevlar is especially suitable the use of which results in a belt of great load capacity. Even when the aforementioned polyamides have already a good wear resistance and temperature resistance, by mixing in metal fibers a further increase of the service life with more uniform surface quality can be achieved. In addition to the increased wear-resistance, the metal fibers provide for an increased thermal conductivity so that the heat transfer is improved. As metal fibers it is possible to use non-corroding metal fibers, especially stainless steel fibers, which are admixed in an amount of up to 3.5 weight percent to the base material, i.e., aromatic polyamide (96.5 weight percent).

The other threads of the woven belt of the top, central, and bottom woven layer are comprised of plastic material, that is a material of approximately 65% polyester and 35% viscose (viscose staple fibers).

The present invention is, of course, in no way restricted to the specific disclosure of the specification and drawings, but also encompasses any modifications within the scope of the appended claims.

What I claim is:

1. A woven belt for a corrugated cardboard machine, said woven belt comprising:

a central woven layer for absorbing tensile stress, wherein said central woven layer is comprised of first warp threads and first weft threads, wherein a weave pattern of said central woven layer is such that said first warp threads cross at least two of said first weft threads on one side of said central woven layer before crossing over to the other side of said central woven layer;

a woven top layer connected to the upper side of said central woven layer and a woven bottom layer connected to the bottom side of said central woven layer;

said woven top layer providing a support surface for the cardboard;

said woven top layer comprised of second warp threads and second weft threads, wherein a weave pattern of said woven top layer is such that said second warp threads cross at least two of said second weft threads on one side of said woven top layer before crossing over to the other side of said woven top layer;

said woven bottom layer comprised of third warp threads and third weft threads, wherein a weave pattern of said woven bottom layer is such that said third warp threads cross one of said third weft threads on an inner side of said woven bottom layer facing said central woven layer before crossing over to the outer side of said woven bottom layer and wherein said third warp threads cross at least three of said third weft threads on the outer side of said woven bottom layer before crossing over to the inner side of said woven bottom layer;

said second warp threads arranged in first thread groups and said second warp threads within each one of said first thread groups staggered relative to one another;

said third warp threads arranged in second thread groups and said third warp threads within each one of said second thread groups staggered relative to one another;

first binding threads for weaving together said woven top layer and said central woven layer;

second binding threads for weaving together said woven bottom layer and said central woven layer;

said first, second, and third weft threads tied off within said woven top layer, said central woven layer, and said woven bottom layer, respectively;

said woven belt in a longitudinal direction thereof having longitudinal edge portions and a longitudinal center portion between said edge portions;

said second warp threads include at least one outer warp thread positioned within said edge portions and inner warp threads positioned within said center portion;

said at least one outer warp thread extending in a longitudinal direction of said woven belt and consisting of a material having at least one of a greater wear resistance and a greater temperature resistance than said inner warp threads.

2. A woven belt according to claim 1, wherein said at least one outer warp thread is positioned directly adjacent to a longitudinal edge of said edge portions.

3. A woven belt according to claim 1, comprising a plurality of said outer warp threads arranged adjacent to a longitudinal edge of said edge portions.

4. A woven belt according to claim 1, wherein said first binding threads, extending in the longitudinal direction of said woven belt, consist of the same material as said at least one outer warp thread.

5. A woven belt according to claim 1, wherein all of said warp threads within said edge portions and all of said binding threads within said edge portion consist of the same material as said at least one outer warp thread.

6. A woven belt according to claim 1, wherein said edge portions have a width transverse to the longitudinal direction of said woven belt of 200 mm.

7. A woven belt according to claim 1, wherein said material of said at least one outer warp thread is an aromatic polyamide.

8. A woven belt according to claim 7, wherein said aromatic polyamide is Kevlar.

9. A woven belt according to claim 1, wherein said material of said at least one outer warp thread is a mixture of an aromatic polyamide and metal fibers.

10. A woven belt according to claim 9, wherein said metal fibers are stainless steel fibers.

11. A woven belt according to claim 9, wherein said mixture consists of 96.5% of said aromatic polyamide and 3.5% of said metal fibers based on the weight of said mixture.

12. A woven belt according to claim 1, wherein said warp threads, said weft threads, and said binding threads consist of 65% polyester and 35% viscose.

13. A woven belt according to claim 1, wherein all of said warp threads within said edge portions and all of said binding threads within said edge portion consist of the same material as said at least one outer warp thread and wherein said material is an aromatic polyamide.

14. A woven belt according to claim 13, wherein said aromatic polyamide is Kevlar.

15. A woven belt according to claim 13, wherein said material is a mixture of an aromatic polyamide and metal fibers.

16. A woven belt according to claim 15, wherein said metal fibers are stainless steel fibers.

17. A woven belt according to claim 15, wherein said mixture consists of 96.5% of said aromatic polyamide and 3.5% of said metal fibers based on the weight of said mixture.

* * * * *